US009862067B2

(12) United States Patent
Winterfjord et al.

(10) Patent No.: US 9,862,067 B2
(45) Date of Patent: Jan. 9, 2018

(54) FLOOR GRINDING MACHINE

(71) Applicant: HUSQVARNA AB, Huskvarna (SE)

(72) Inventors: Olof Winterfjord, Västra Frölunda (SE); Robert Gustafsson, Uddevalla (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/307,055

(22) PCT Filed: Apr. 30, 2014

(86) PCT No.: PCT/SE2014/050533
§ 371 (c)(1),
(2) Date: Oct. 27, 2016

(87) PCT Pub. No.: WO2015/167376
PCT Pub. Date: Nov. 5, 2015

(65) Prior Publication Data
US 2017/0057042 A1 Mar. 2, 2017

(51) Int. Cl.
*B24B 7/18* (2006.01)
*A47L 11/40* (2006.01)

(52) U.S. Cl.
CPC ..... *B24B 7/186* (2013.01); *A47L 11/40* (2013.01); *A47L 11/4075* (2013.01); *B24B 7/18* (2013.01); *B24B 7/188* (2013.01)

(58) Field of Classification Search
CPC ..... A47L 11/40; A47L 11/4075; B24B 7/18; B24B 7/186; B24B 7/188; B24B 7/19; B25F 5/02
See application file for complete search history.

(56) References Cited

U.S. PATENT DOCUMENTS 3,203,707 A * 8/1965 Anderson ..... A47L 11/4075 15/49.1
3,204,272 A * 9/1965 Greene ..... A47L 11/28 15/144.1
3,631,559 A 1/1972 Gaudry
(Continued)

FOREIGN PATENT DOCUMENTS

GB 2410206 A 7/2005

OTHER PUBLICATIONS

International Search Report and Written Opinion for International Application No. PCT/SE2014/050533 dated Dec. 15, 2014.
(Continued)

*Primary Examiner* — Timothy V Eley
(74) *Attorney, Agent, or Firm* — McNair Law Firm, P.A.

(57) ABSTRACT

A grinding or polishing machine (10) may include a working assembly (20) and a foldable cart (30). The working assembly (20) may include a grinding head (26) rotatable to engage a surface for grinding or polishing. The foldable cart (30) may be releasably coupled to the working assembly (20). The foldable cart (30) may include a mobility assembly (100) including at least one wheel (102) and a frame (104), and a handle assembly (110) operably coupled to the frame (104). The handle assembly (110) may include a first frame portion (112) and a second frame portion (114). The first frame portion (112) and the second frame portion (114) may be operably coupled to each other via a folding joint (120).

15 Claims, 9 Drawing Sheets

(56) References Cited

U.S. PATENT DOCUMENTS

| | | | | |
|---|---|---|---|---|
| 5,253,384 | A * | 10/1993 | Joines | A47L 11/162 15/49.1 |
| 5,674,120 | A | 10/1997 | Legatt et al. | |
| 8,684,796 | B2 * | 4/2014 | McCutchen | B24B 7/186 451/350 |
| 2003/0226225 | A1 | 12/2003 | Graceffo | |
| 2004/0045108 | A1 * | 3/2004 | Fellhauer | A47L 11/4075 15/49.1 |
| 2005/0283940 | A1 | 12/2005 | Hertrick et al. | |
| 2014/0227949 | A1 * | 8/2014 | Popov | B24B 7/186 451/353 |
| 2015/0328739 | A1 * | 11/2015 | Rogers | B24B 7/18 451/353 |

OTHER PUBLICATIONS

International Preliminary Report on Patentability for International Application No. PCT/SE2014/050533 dated Nov. 1, 2016.

* cited by examiner

FLOOR GRINDING MACHINE

TECHNICAL FIELD

Example embodiments relate to a floor grinding or polishing machine, and more particularly relate to a floor grinding or polishing machine with a foldable cart that can be removably attached thereto.

BACKGROUND OF THE INVENTION

Floor grinding machines are commonly used in the construction or remodeling industries to polish or grind floors or other working surfaces. Often they have a grinding or polishing head, two wheels and a handle. Particularly when working with large areas, the machines are generally attached to a handle assembly that enables the operator to control the machine while walking or standing behind the machine.

The machine may therefore be relatively easy to transport and use around working areas on a same floor or otherwise at the same location. However, the fully assembled apparatus may be quite heavy and difficult to transport to other floors or to other locations. Furthermore, the fully assembled apparatus may take up a relatively large amount of storage space, and require a lorry or a very big car for transportation.

BRIEF DISCLOSURE OF THE INVENTION

Therefore there is a need for an assembly that can more easily be transported and/or stored. As such, some example embodiments may provide a foldable cart that can easily be configured to take up less space or give better access to portions of the machine. The foldable cart can also be easily removed from the machine to allow the machine to be transported or stored in separate portions (i.e., the machine head and the cart in its folded configuration). Hereby the two units can be transported in most ordinary cars, which may be a most favourable feature for many operators.

In accordance with an example embodiment, a grinding or polishing machine may therefore be provided. The machine may include a working assembly and a foldable cart. The working assembly may include a grinding head rotatable to engage a surface for grinding or polishing. The foldable cart may be releasably coupled to the working assembly. The foldable cart may include a mobility assembly including at least one wheel and a frame, and a handle assembly operably coupled to the frame. The handle assembly may include a first frame portion and a second frame portion. The first frame portion and the second frame portion may be operably coupled to each other via a folding joint.

BRIEF DESCRIPTION OF THE DRAWINGS

In the following description of preferred embodiments, reference will be made to the accompanying drawings, in which.

FIG. 7, which includes FIG. 8, which includes

DESCRIPTION OF PREFERRED EMBODIMENTS

Figure 1:
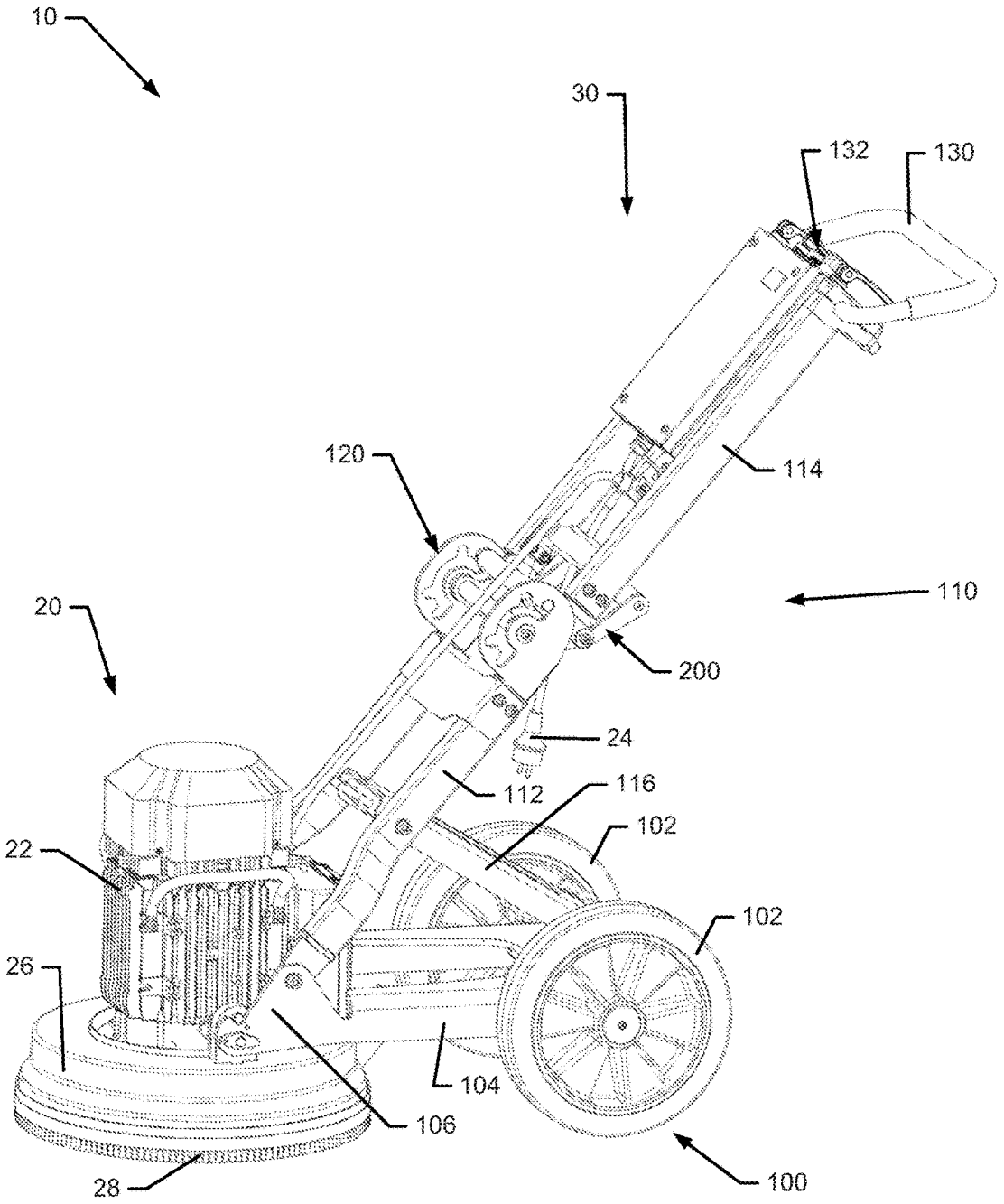
FIG. 1 shows a perspective, side view of a grinding or polishing machine in accordance with an example embodiment.

The present invention will be described more fully hereinafter with reference to the accompanying drawings, in which example embodiments of the invention incorporating one or more aspects of the present invention are shown. In the drawings, like numbers refer to like elements.

As mentioned above, some example embodiments may provide operators with the ability to easily remove the working assembly from the mobility assembly and handle assembly of the machine. The mobility assembly and handle assembly may then be integrated into a foldable cart that can easily be configured in multiple folded positions. FIGS. 1-8 show various views of example embodiments from different perspectives, and in different positions, in order to facilitate description of some example embodiments.

As shown in FIGS. 1-4, a grinding or polishing machine 10 according to an example embodiment may include a working assembly 20 and a foldable cart 30. The working assembly 20 may include motor 22 that may be electric powered. In some cases, the motor 22 may be powered by mains power via a cord 24. The cord 24 may be automatically retractable (e.g., using a coiling apparatus), or may be manually extendable to enable the cord 24 to be mated with a suitable power supply. Alternatively the motor 22 can be powered by onboard batteries, or even a combustion engine can be used as motor.

In an example embodiment, the motor 22 may rotate a grinding head 26 when the motor 22 is powered. As such, for example, the motor 22 may rotate a shaft to which the grinding head 26 is operably coupled. The grinding head 26 may therefore be rotatable by the motor 22 to engage a surface for grinding or polishing. In some cases, the grinding head 26 may further be operably coupled to a grinding disk 28. The grinding disk 28 may have a working surface that may be coated with or otherwise integrated with any desirable material (e.g., diamond) to facilitate grinding or polishing of the working surface. As such, for example, the grinding head 26 may be fitted with different grinding disks 28 that may be configured with different grades of material or different materials to achieve corresponding different grinding or polishing characteristics. Alternatively or additionally, as one grinding disk 28 becomes worn, it may be replaced with an unworn replacement disk.

As shown in FIG. 1, the working assembly 20 may be engaged with the foldable cart 30 in a releasable manner. Thus, the foldable cart 30 may be releasably coupled to the working assembly 20 for enabling transport of the working assembly 20 via the foldable cart 30 or separate from the foldable cart 30. Moreover, when connected to the working assembly 20, the foldable cart 30 may be used to transport the working assembly 20 during operation of the working assembly 20 or between different operating periods of the working assembly 20.

The foldable cart 30 may include a mobility assembly 100 and a handle assembly 110 that may cooperate with each other to hold the working assembly 20 when in an operating position (i.e., not folded), and also cooperate with each other to reduce the size or otherwise change the configuration of the foldable cart 30 when in a folded or collapsed position.

The mobility assembly 100 may include one or more wheels 102 (e.g., two wheels coupled via an axle) and a frame 104. The frame 104 may include two frame members (e.g., a right side member and left side member) that extend parallel to (and on opposite sides of) a longitudinal centerline of the foldable cart 30 from the axle that operably couples to the wheels, forward toward a point at which the mobility assembly 100 is operably coupled to the handle assembly 110. The frame 104 may also be releasably coupled to the working assembly 20 at a distal end thereof relative to the axle. In an example embodiment, the frame 104 may terminate at a mounting bracket 106 that may be pivotally coupled to the handle assembly 110 and releasably connected to the working assembly 20. In particular, for example, the mounting bracket 106 may include an aperture through which a removable screw or pin 142 may be passed. The removable screw or pin 142 may be further secured with a cotter pin or other such securing device in some cases. Thus, one instance of the mounting bracket 106 may be provided at the end of each member of the frame 104 to lie proximate to a portion of the working assembly 20 to enable the working assembly 20 to be affixed to the frame 104 at opposing sides of the working assembly 20. Although some example embodiments provide the mounting bracket 106 as an end portion of the frame 104, it should be appreciated that the mounting bracket 106 could alternatively be a portion of the handle assembly 110 and the frame 104 could be pivotally attached thereto. Additionally or alternatively, the working assembly 20 may be releasably attachable via the removable screw or pin 142 to either of the first frame portion 112.

The handle assembly 110, which is operably coupled to the frame 104 at the mounting bracket 106 in this example, may include a first frame portion 112 and a second frame portion 114. In an example embodiment, the first frame portion 112 and the second frame portion 114 may each include two elongate members that extend parallel to each other and are spaced apart from each other (e.g., equidistant from the longitudinal centerline of the foldable cart 30). However, it should be appreciated that the first frame portion 112 and the second frame portion 114 could alternatively be embodied as a single elongate member that may, for example, extend along the longitudinal centerline of the foldable cart 30.

The first frame portion 112 may be located proximate to the mounting bracket 106 at a first end thereof and may pivotally connect to the second frame portion 114 at a second end thereof (opposite the first end). In an example embodiment, the first frame portion 112 and the second frame portion 114 may be operably coupled to each other via a folding joint 120. The second frame portion 114 may therefore be coupled to the first frame portion 112 at the folding joint 120 at a first end of the second frame portion 114, and a handle 130 of the handle assembly 110.

In some embodiments, an operating panel 132 may be provided at the distal end of the second frame portion 114 proximate to where the handle 130 engages the second frame portion 114. The operating panel 132 may include control switches, buttons or other operable members that enable the operator to control power, speed or other functional characteristics of the working assembly 20. As such, in some cases, wires or cables may pass through one or more of the members of the first frame portion 112 and second frame portion 114 to electrically couple the operating panel 132 to the motor 22.

As can be appreciated from FIGS. 1-7, the frame 104 may lie substantially within a plane that (during operation) is substantially parallel to the ground plane upon which the grinding or polishing machine 10 operates. When the foldable cart 30 is in the operating position, folding joint 120 may be positioned such that the first frame portion 112 and the second frame portion 114 lie end to end next to each other and within a plane that forms an acute angle relative to both the frame 104 and the ground plane. Thus, the first frame portion 112 and the second frame portion 114 may extend away from the working assembly 20 over the frame 104.

The folding joint 120 may therefore pivotally join respective ends of the first frame portion 112 (i.e., the end of the first frame portion 112 that is distally located relative to the working assembly 20) and the second frame portion 114 (i.e., the end of the second frame portion 114 that is proximally located relative to the working assembly 20). In an example embodiment, the folding joint 120 may be operable to enable the first frame portion 112 and the second frame portion 114 to be repositioned relative to one another about a pivot axis 202 defined at the folding joint 120. The folding joint 120 may also be lockable in a plurality of folded positions to enable the first frame portion 112 and the second frame portion 114 to be rigidly held in corresponding different folded positions.

Figure 7A:
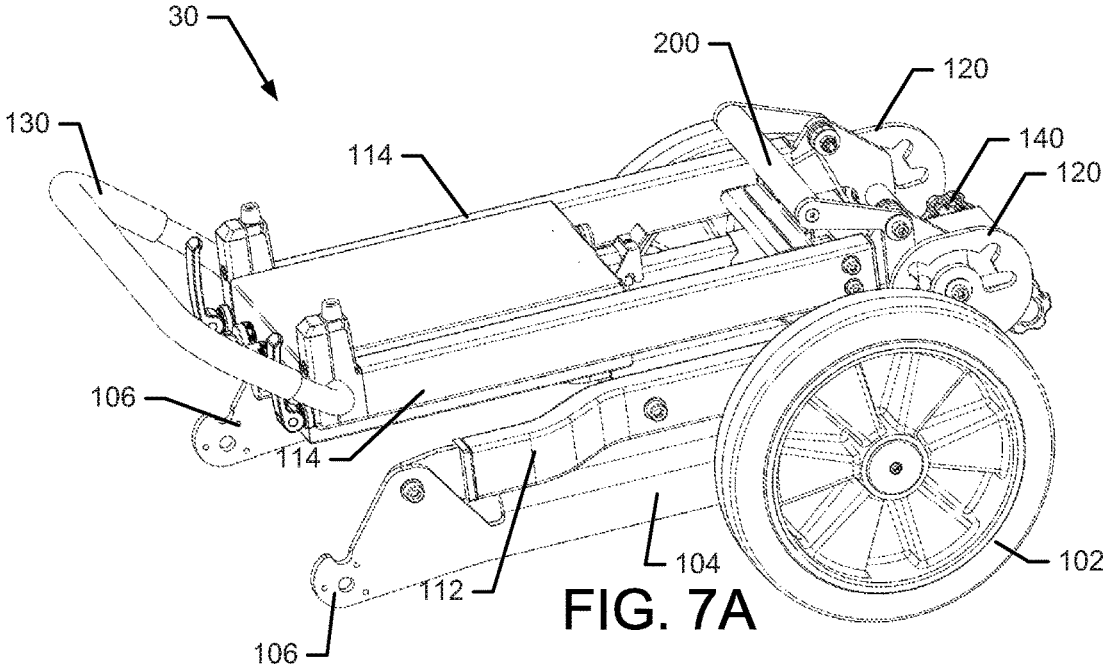
FIGS. 7A and 7B, shows a perspective view of the cart of grinding or polishing machine with the working assembly removed in a folded configuration in accordance with an example embodiment.
Figure 7B:
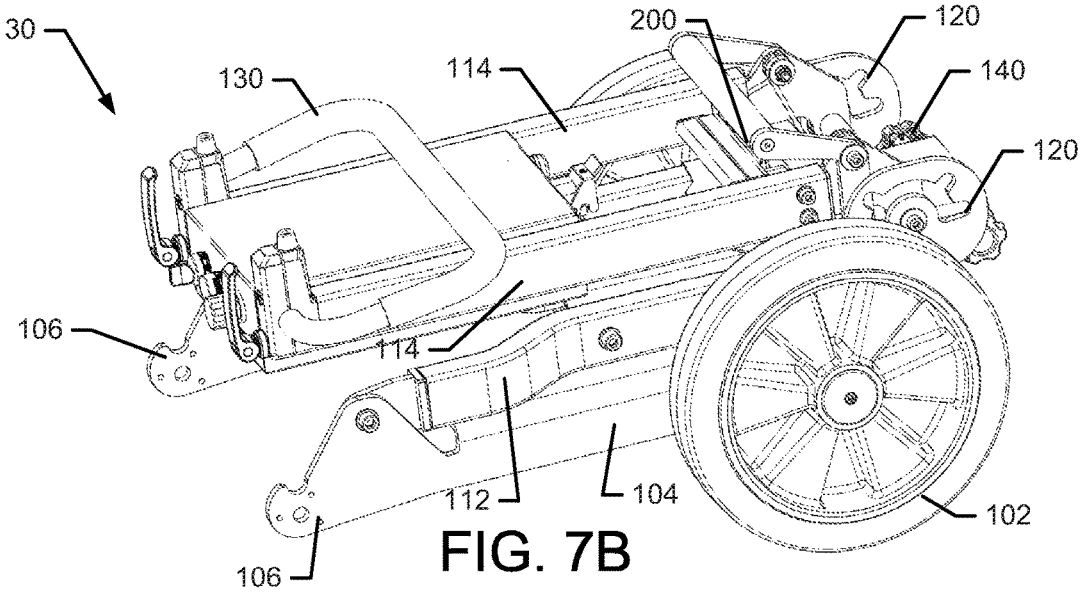

In an example embodiment, the folding joint 120 may be operable to be locked in at least an operating position in which the first frame portion 112 and the second frame portion 114 lie substantially in a same plane and a folded position in which the first frame portion 112 and the second frame portion 114 lie in different planes. The different planes may form an obtuse angle (as in FIG. 2) or an acute angle (as in FIG. 3). However, when the folding joint 120 is fully folded, the plane in which the first frame portion 112 lies may be substantially parallel to the plane in which the second frame portion 114 lies as shown in FIG. 7A. The first frame portion 112 and the second frame portion 114 may lie next to each other in this configuration for minimizing the size of the foldable cart 30. In the example of FIG. 7A, the handle 130 remains in an extended position. However, in some cases, it may be further possible to fold the handle 130 as well, so that the handle 130 lies proximate to the second frame portion 114 in a stowed position as shown in FIG. 7B. The handle 130 may be rotatable between the extended position and the stowed position based on tightening of a clamp assembly that may engage the handle 130 at a distal end of the second frame portion 114.

Figure 2:
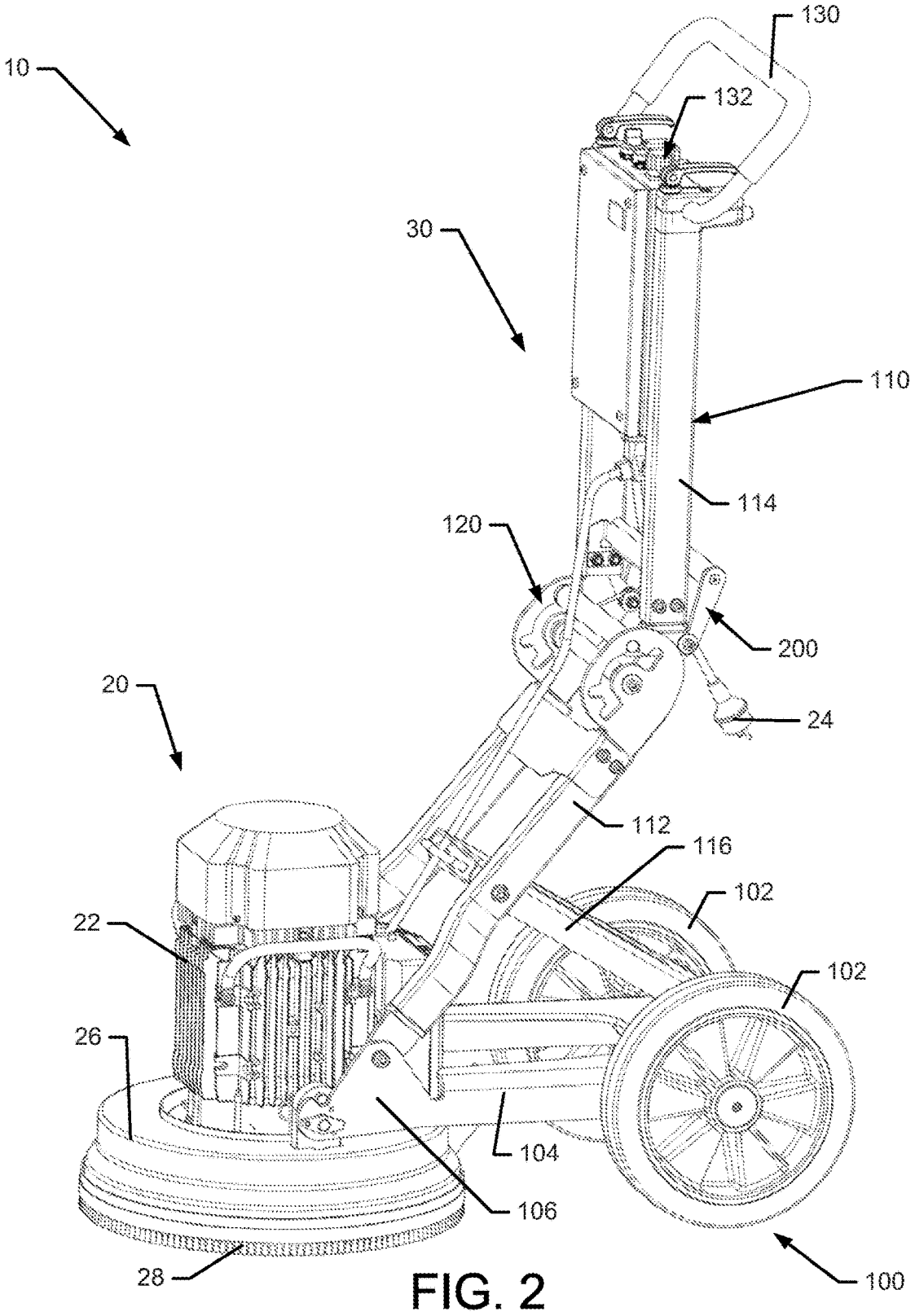
FIG. 2 shows a perspective, side view of the grinding or polishing machine with its cart in a first partially folded configuration in accordance with an example embodiment.
Figure 3:
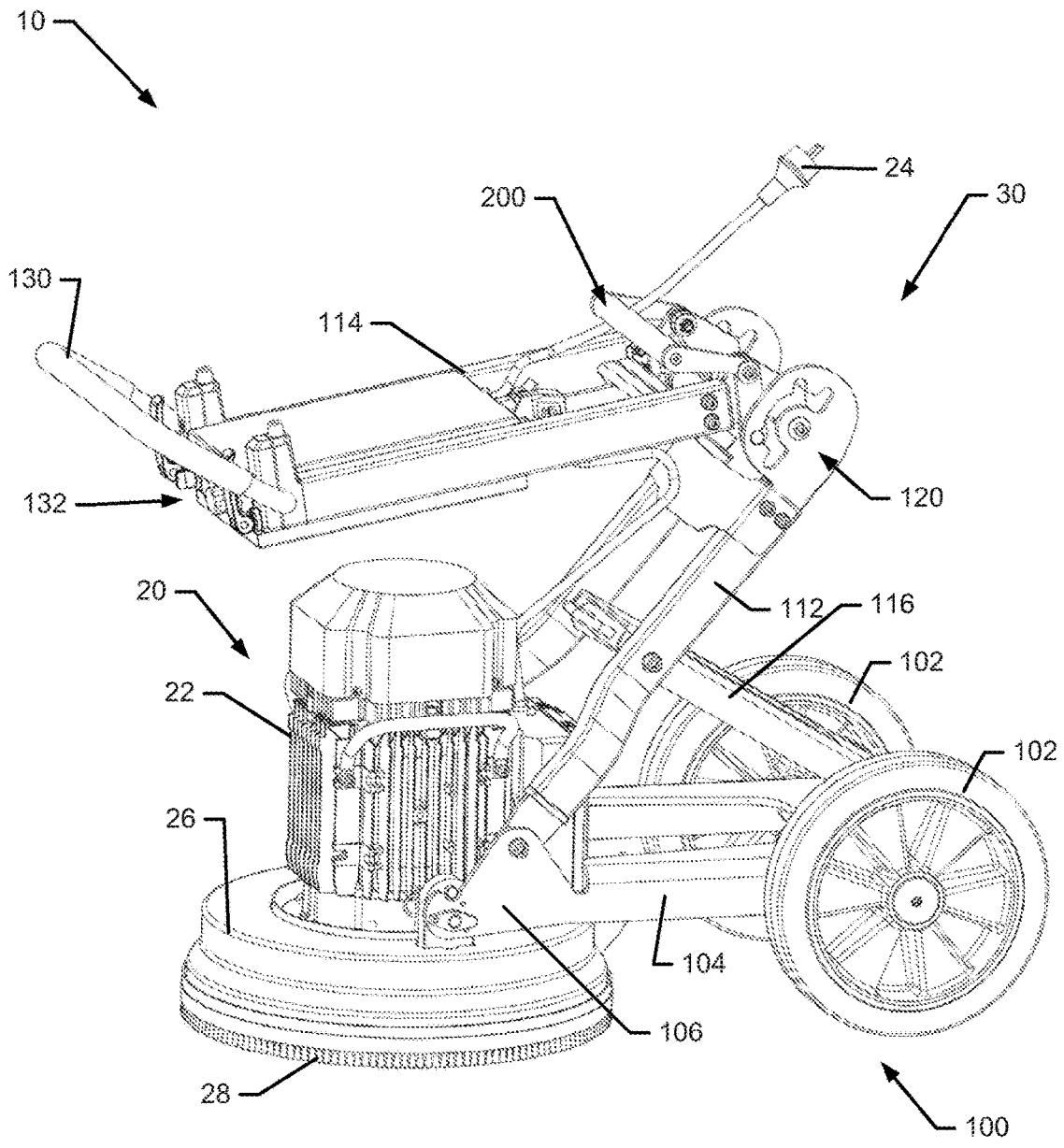
FIG. 3 shows a perspective, side view of the grinding or polishing machine with the cart in a second partially folded configuration in accordance with an example embodiment.
Figure 4:
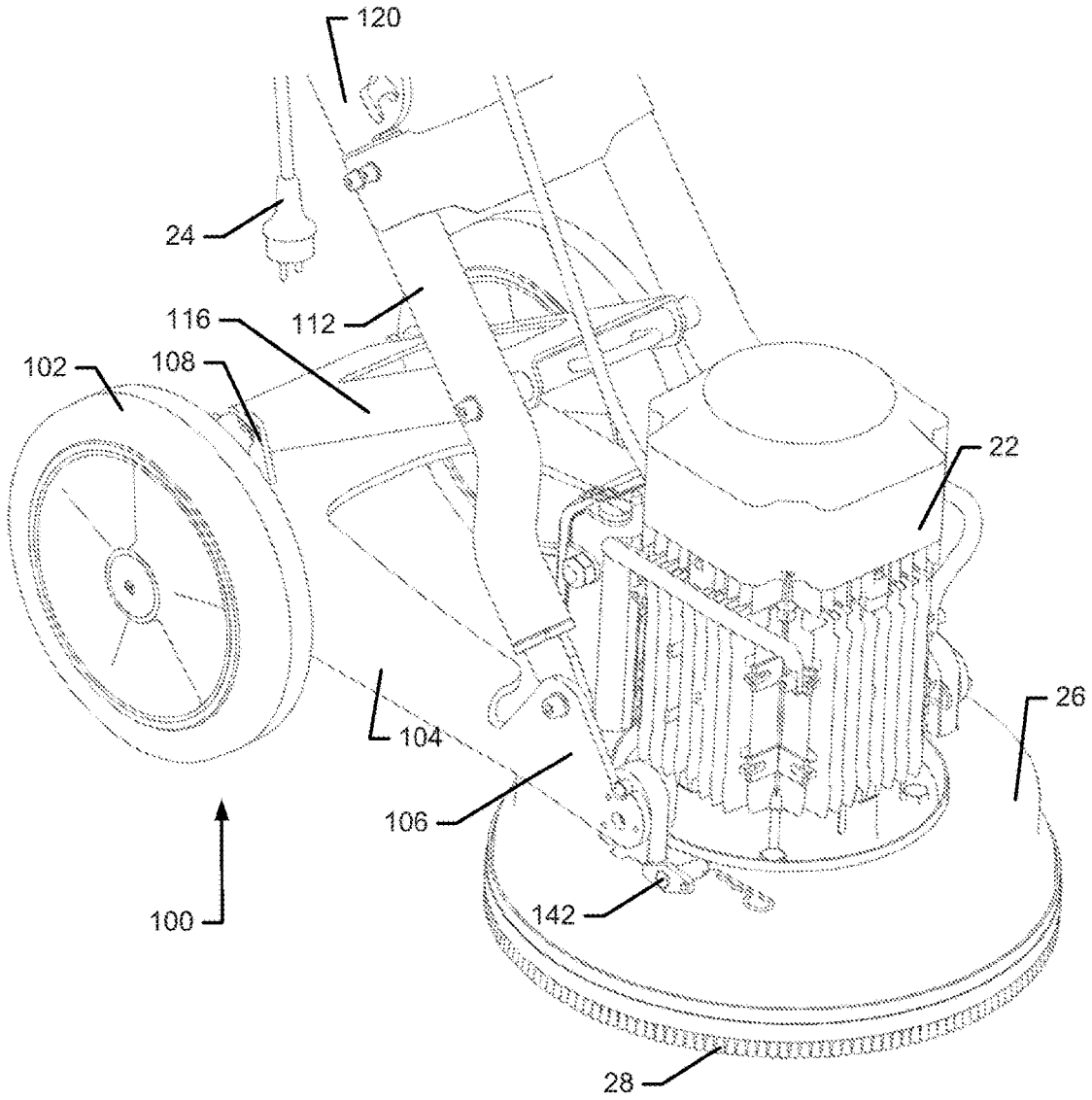
FIG. 4 shows a perspective view of a mobility assembly and working assembly of the grinding or polishing machine in accordance with an example embodiment.
Figure 5:
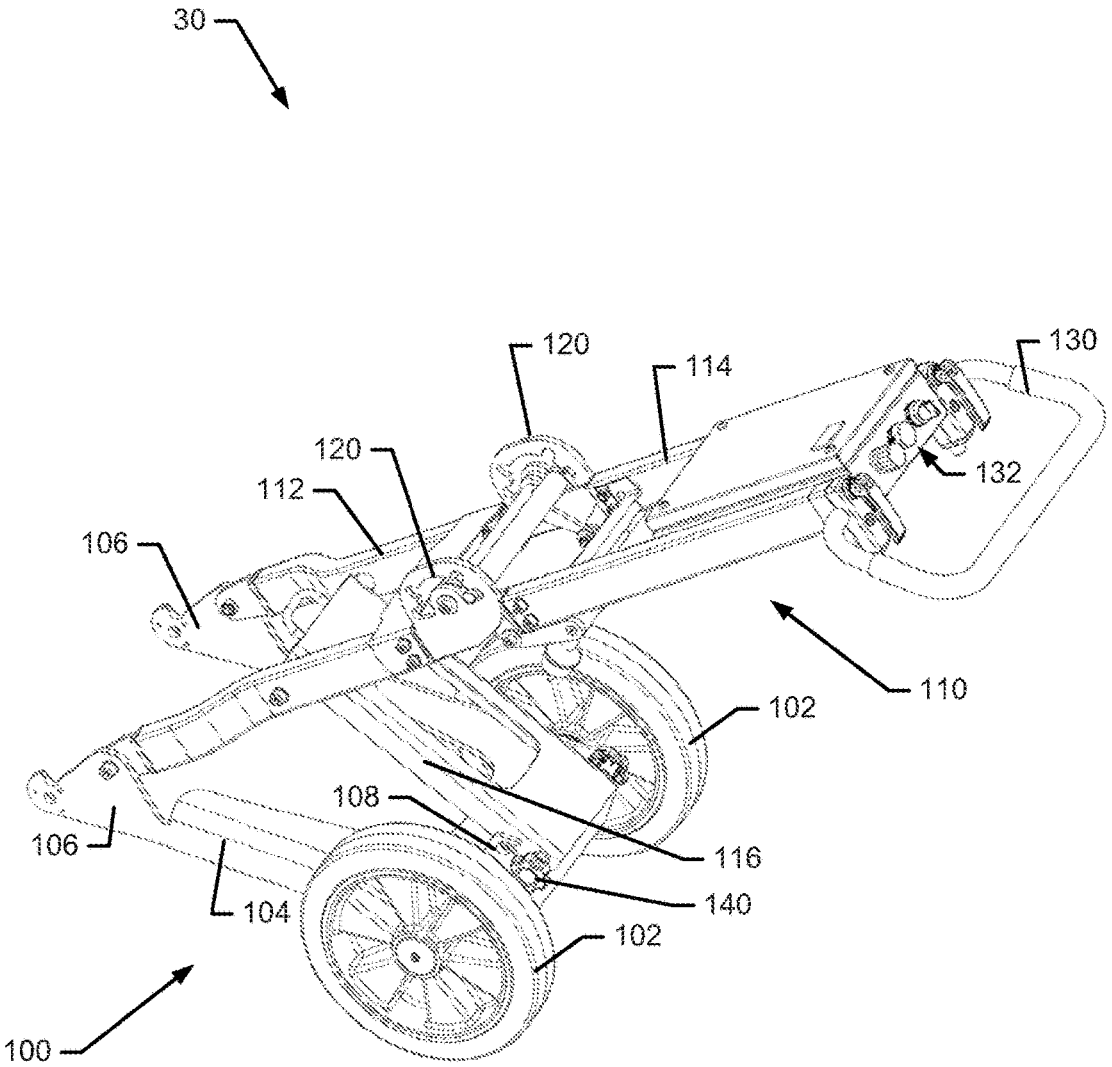
FIG. 5 shows a perspective view of the cart of the grinding or polishing machine with the working assembly removed in accordance with an example embodiment.
Figure 6:
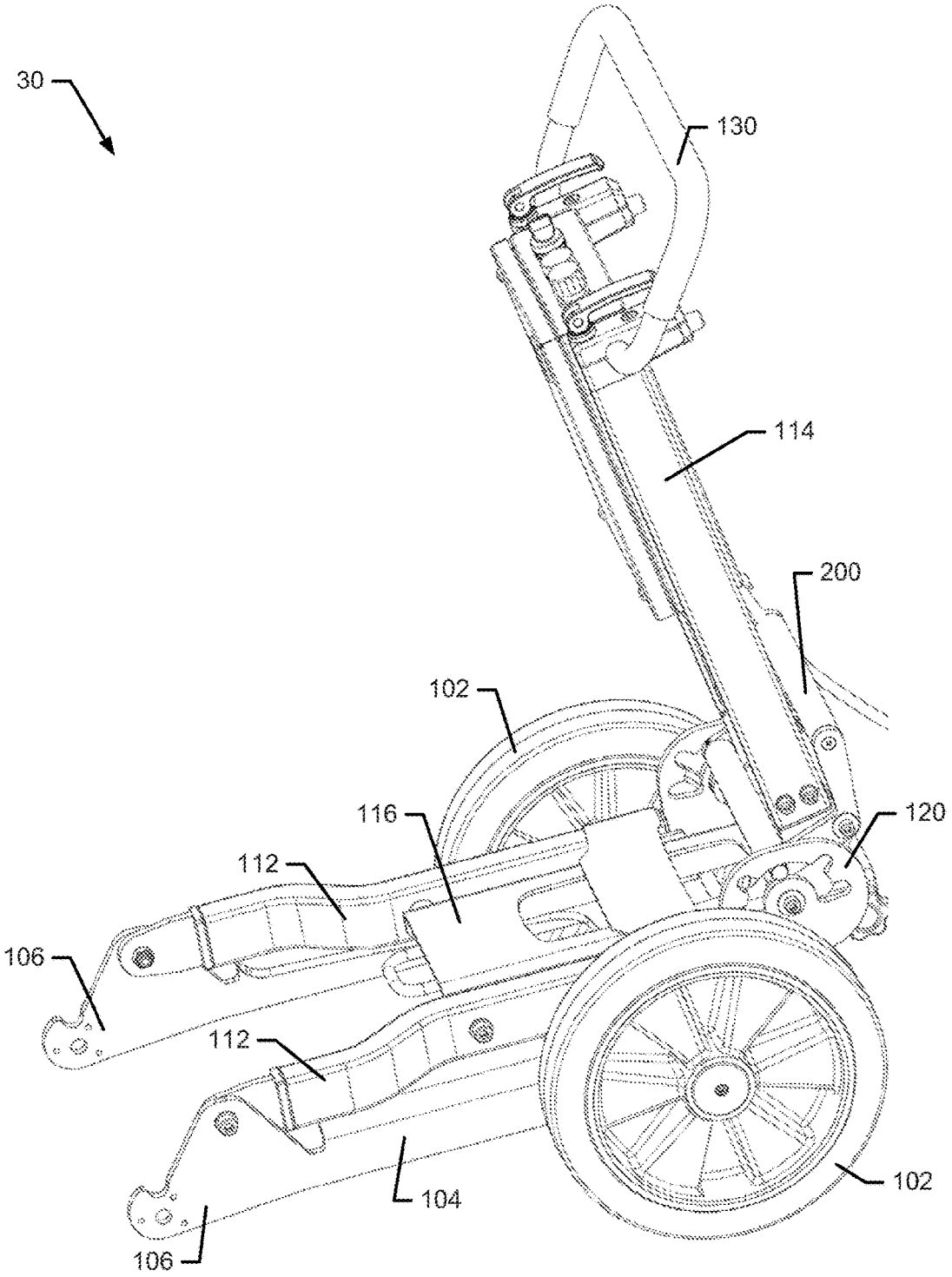
FIG. 6 shows a perspective view of the cart of the grinding or polishing machine with the working assembly removed in a partially folded configuration in accordance with an example embodiment.

As can be appreciated from FIGS. 1-8, the first frame portion 112 and the second frame portion 114 may pivot relative to each other over a range of about 180 degrees about the pivot axis 202 via the folding joint 120. FIGS. 1, 5 and 8A show the folding joint 120 in a position that corresponds to the foldable cart 30 being in an operating position (i.e., with the first frame portion 112 and the second frame portion 114 in the same plane or forming a 180 angle relative to each other). Meanwhile, FIGS. 2 and 8C show the folding joint 120 moved to a different discrete position where the first frame portion 112 and the second frame portion 114 form an obtuse angle about the pivot axis 202 of the folding joint 120. FIGS. 3 and 8E show the folding joint 120 moved to a different discrete position where the first frame portion 112 and the second frame portion 114 form an acute angle about the pivot axis 202 of the folding joint 120. Finally, FIGS. 7A, 7B and 8F show the folding joint 120 moved to yet a different discrete position where the first frame portion 112 and the second frame portion 114 lie proximate to each other and in parallel planes while the foldable cart 30 is in the folded position or state.

To facilitate movement through the various different discrete positions in which the foldable cart 30 can be provided by moving (and locking) the folding joint 120, the folding joint 120 may be provided with a locking assembly 200. The locking assembly 200 of the folding joint 120 may be disposed proximate to the folding joint 120 and include a positionable lever that is movable to enable a detent 214 extending in a direction that is substantially parallel to the pivot axis 202 to be selectively inserted into various notches 212 of an arcuate shaped slot 210 based on operation of the locking assembly 200. As such, the locking assembly 200 may interface with the arcuate shaped slot 210 that extends coaxial with and around the pivot axis 202 to facilitate locking the folding joint 120 in various positions and moving the folding joint 120 between such positions.

FIG. 8 shows the arcuate shaped slot 210 in greater detail. Referring mainly to FIG. 8, the arcuate shaped slot 210 can be seen to include a plurality of the notches 212 that extend outwardly in a mainly radial direction away from the pivot axis 202. Alternatively the notches could extend inwardly in a mainly radial direction. FIG. 8 illustrates four such notches 212, and each one of the notches 212 corresponds to one of the discrete positions described above and shown in FIGS. 8A, 8C, 8E and 8F, respectively. Thus, each of the notches 212 corresponds to one of the folding (or folded) positions (as in FIGS. 8C, 8E and 8F) or the operating position (as in FIG. 8A). However, it should be appreciated that any desirable number of notches 212 could be included to define the corresponding number of discrete positions in which the folding joint 120 may be locked. Although FIG. 8 shows a plurality of notches 212, it should be appreciated that some embodiments could include as few as one notch, or any other desirable number of notches. In an example in which a single notch is provided, the notch may correspond to the operating position. Then, if additional notches 212 are provided, each additional notch may correspond to another discrete folding position.

Figures 8A, 8B, 8C:
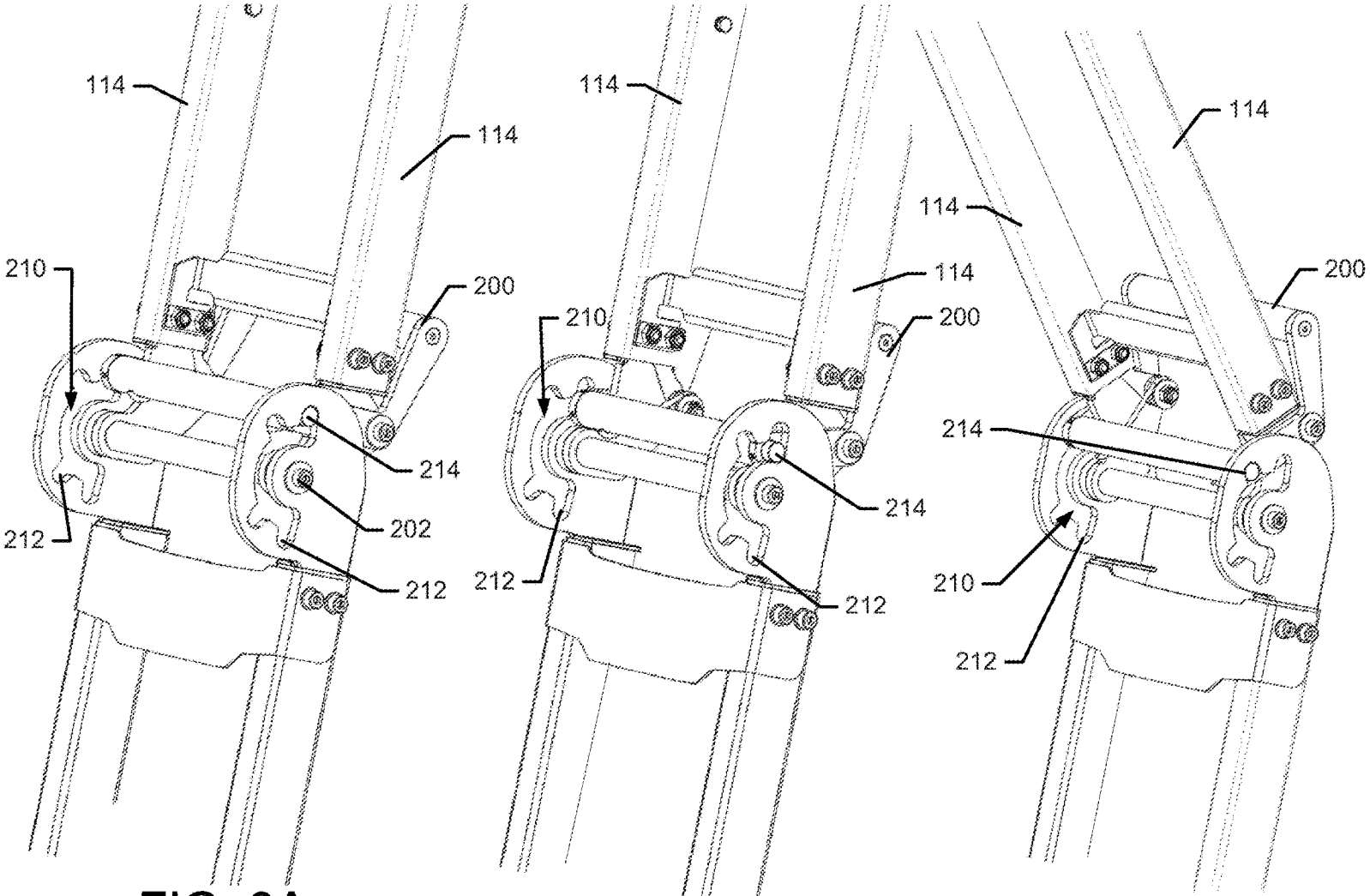
FIGS. 8A, 8B, 8C, 8D, 8E and 8F, shows transitioning of a folding joint of the machine to the folded state in accordance with an example embodiment.
Figure 8F:
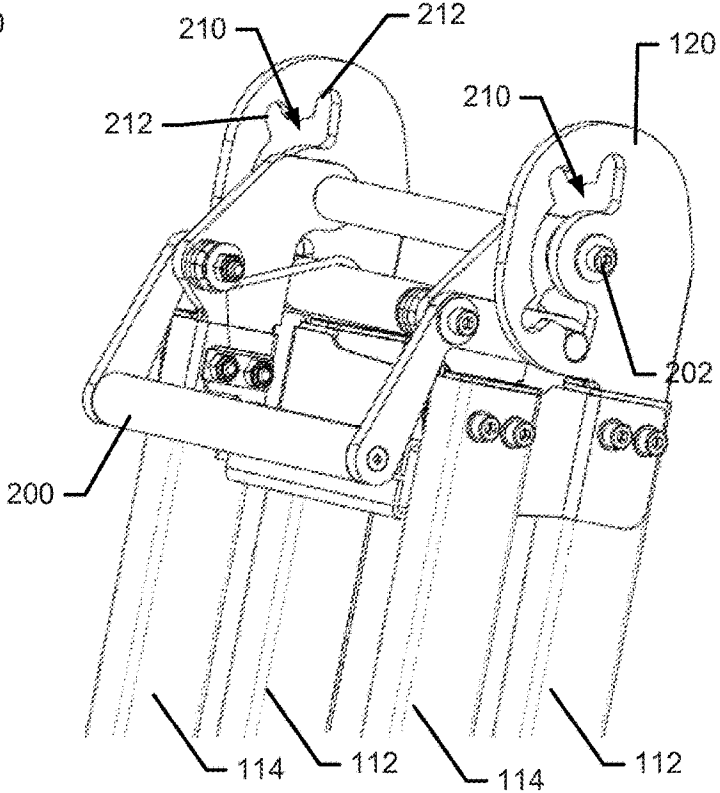
Figure 8E:
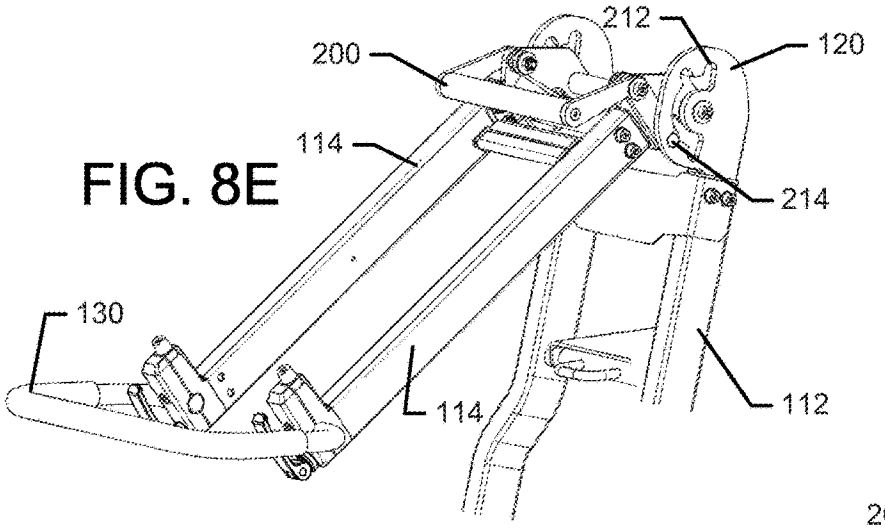
Figure 8D:
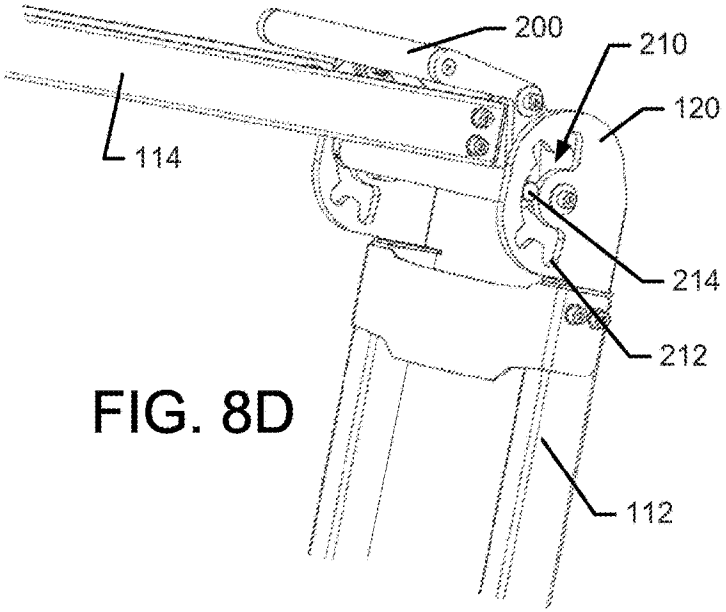

In an example embodiment, the locking assembly 200 may be in a rest position while the detent 214 is seated in a selected one of the notches 212. However, the lever of the locking assembly 200 may be actuated (e.g., pulled) to take the locking assembly 200 out of the rest position and remove the detent 214 from the selected one of the notches 212 to permit the detent 214 to slide through the arcuate shaped slot 210 to a different selected one of the notches 212 to define a different discrete position for the folding joint 120. FIG. 8B illustrates the folding joint 120 in a transition state between the operating position shown in FIG. 8A and a first folding position shown in FIG. 8C based on operation of the locking assembly 200. FIG. 8D illustrates the folding joint 120 in a transition state between the first folding position shown in FIG. 8C and a second folding position shown in FIG. 8E based on operation of the locking assembly 200. FIG. 8F illustrates the folding joint 120 after a transition between the second folding position shown in FIG. 8E into a third folding position shown in FIG. 8F based on operation of the locking assembly 200.

Although the foldable cart 30 may operate exclusively with the handle assembly 110 being coupled to the mobility assembly 100 at the mounting bracket 106 that is also used to couple the foldable cart 30 to the working assembly 20, e.g with extra screws to lock the first frame portion 112 in the position shown in FIG. 1-3. However, some example embodiments may add further structure to make the foldable cart 30 more robust. For example, a support member 116 may be added between the mobility assembly 100 and the handle assembly 110 to provide further structural support to the handle assembly 110. If employed, the support member 116 could be a portion of either the mobility assembly 100, the handle assembly 110 or could be a separate component. In some cases, the support member 116 may include two elongate members that extend substantially parallel to the longitudinal axis of the foldable cart 30 to extend between the frame 104 and the first frame portion 112 to provide support therebetween. The support member 116 may also include one or more cross members that extend between the elongate members. As shown, the support member 116 may be designed from a metal sheet that is folded and welded to shape. It could also be a composite design. The elongate members may be operably coupled to the frame 104 and the first frame portion 112 at respective ends of the elongate members.

Generally speaking, in order to facilitate the capability of the foldable cart 30 to be completely folded into the fully folded configuration of FIG. 7, one or both of the ends of the elongate members of the support member 116 may be removable from being affixed to either of the frame 104 or the first frame portion 112. In an example embodiment, the support member 116 may be pivotally attached at a first end thereof to the first frame portion 112 and releasably attachable at a second end thereof to the frame 104. In this regard, for example, the first end of the support member 116 may be rotatably or pivotally fixed to the first frame portion 112 at a part of the first frame portion 112 that is spaced apart from the mounting bracket 106 (e.g., at an approximate middle of the longitudinal length of the first frame portion 112). Meanwhile, the second end of the support member 116 may be removably engaged with a second mounting bracket 108 at a rear portion of the frame 104 (e.g., between the wheels 102). The second end of the support member 116 may be removably attached to the frame 104 via the second mounting bracket 108 via a threaded fastener 140 that may pass through a portion of the second mounting bracket 108 to engage with the support member 116 and enable the threaded fastener 140 to be tightened onto the second mounting bracket 108. As such, the support member 116 may be locked or unlocked in engagement with the frame 104.

FIGS. 1-4 show the support member 116 in a locked state. However, in FIG. 5, the threaded fastener 140 has been loosened to an unlocked state so that the threaded fastener 140 can be removed from the second mounting bracket 108 and the support member 116 can pivot relative to the engagement with the first frame portion 112 to enable the support member 116 to be folded within or between the elongate members of the first frame portion 112 as the foldable cart 30 is collapsed to the folding position of FIG. 7. In order to support the folding of the foldable cart 30 with the support member 116 included therein, the support member 116 may have a width that is narrower than the narrowest space between the elongate members of the first frame portion 112.

Furthermore, in some examples, a width of the frame 104 of the mobility assembly 100 may be provided to be greater than a width of second frame portion 114. Meanwhile, the first frame portion 112 may be provided to have a first width proximate to the folding joint 120 that is substantially equal to the width of the second frame portion 114. The first frame portion may also have a second width proximate to the mounting bracket 106 of the frame 104. The second width may be substantially equal to the width of the frame 104. This structure further facilitates a compact folding of the foldable cart 30 to reduce the overall amount of space that the foldable cart 30 consumes while in the fully folded or collapsed position or state. In this regard, as can be seen in FIG. 7, when the foldable cart 30 is in the fully folded state, the folding joint 120 may actually be located between the wheels 102 to the mobility assembly 100 (and proximate to the axle).

The structure of the foldable cart 30 gives the operator a great deal of flexibility to easily operate the grinding or polishing machine 10 using the configuration of FIG. 1 or provide the grinding or polishing machine 10 in other advantageous positions for maintenance or storage. For example, the position shown in FIG. 2 could reduce the overall area that the grinding or polishing machine 10 may require for storage. The position shown in FIG. 3 may allow the grinding or polishing machine 10 to be stored or slid under other equipment or structures for transport or storage. The configuration of FIG. 2 or 3 may also or alternatively allow the grinding or polishing machine 10 to be tipped over to rest on either the wheels 102 and on the handle 130, or on the folding joint 120 and the wheels to provide different levels of accessibility to the working assembly 20 for maintenance or repair (e.g., for replacing the grinding disk 28).

Meanwhile, in some cases, the working assembly 20 could be fully removed (as shown in FIG. 5 to facilitate transport of the working assembly 20 and the foldable cart 30 separately. The foldable cart 30 could be transported via its wheels 102 in the condition shown in FIG. 5, but with the support member 116 secured, or may be folded through the sequences shown in FIGS. 6-8 to achieve the fully folded state (with stowed handle) shown in FIG. 7B. In this configuration, the foldable cart 30 may be relatively easily transported or stored with minimal space consumption.

Thus, according to an example embodiment, a grinding or polishing machine may therefore be provided. The machine may include a working assembly and a foldable cart. The working assembly may include a grinding head rotatable to engage a surface for grinding or polishing. The foldable cart may be releasably coupled to the working assembly. The foldable cart may include a mobility assembly including at least one wheel and a frame, and a handle assembly operably coupled to the frame. The handle assembly may include a first frame portion and a second frame portion. The first frame portion and the second frame portion may be operably coupled to each other via a folding joint.

The machine of some embodiments may include additional features that may be optionally added either alone or in combination with each other. For example, in some embodiments, (1) the first frame portion may be rotatably coupled to the frame. Moreover, in some examples, the folding joint may be operable to be locked in at least an operating position in which the first frame portion and the second frame portion lie substantially in a same plane, and a folded position in which the first frame portion and the second frame portion lie in different planes. In some cases, (2) the folding joint may be operable to be locked in a plurality of folded positions. In such an example, the first frame portion may lie in a plane substantially parallel to and spaced apart from a plane in which the second frame portion lies in at least one of the folded positions. In an example embodiment, any or all of the above features may be included and (3) the folding joint may include a pivot axis about which the folding joint is able to rotate over a range of about 180 degrees. In some examples, (4) the folding joint may include an arcuate shaped slot that is coaxial with the pivot axis. The arcuate shaped slot may have as few as one, or a plurality of notches, extending in a radial direction relative to the pivot axis. One notch may correspond to the operating position and each of the additional notches, if included, may correspond to one of the folding positions. In some embodiments, (5) the folding joint may include a locking assembly that is disposed proximate to the folding joint to enable a detent that extends parallel to the pivot axis to be selectively inserted into the notches based on operation of the locking assembly.

In some embodiments, any or all of (1) to (5) may be employed in addition to the optional modifications or augmentations described below. For example, in some embodiments, the machine further includes a handle disposed at a distal end of the second frame portion. The handle may be rotatable between a stowed position in which the handle lies proximate to the second frame portion and an extended position in which the handle is rotated to form an obtuse angle between the second frame portion and the handle. Additionally or alternatively, the machine may include a support member pivotally attached at a first end thereof to the first frame portion and releasably attachable at a second end thereof to the frame. In such an example, the first frame portion may form an acute angle relative to the frame responsive to attachment of the support member to the frame at a rear bracket of the frame. Additionally or alternatively, the frame of the mobility assembly, the first frame portion and the second frame portion may each lie substantially parallel to each other when the handle assembly is in the folded position and the support member is unlocked relative to engagement with the frame. Additionally or alternatively, frame of the mobility assembly may be removably attachable to the support member via a threaded fastener. Additionally or alternatively, a width of the frame of the mobility assembly may be greater than a width of second frame portion. The first frame portion may have a first width proximate to the folding joint. The first width may be substantially equal to the width of the second frame portion. The first frame portion may have a second width proximate to a mounting bracket of the frame at which the frame releasably connects to the working assembly. The second width may be substantially equal to the width of the frame. Additionally or alternatively, the mounting bracket or the first frame portion may be releasably attachable to the working assembly via a removable screw or pin. Additionally or alternatively, the first frame portion may be rotatable at the mounting bracket to enable the first frame portion to be rotated proximate to the frame. Additionally or alternatively, the folding joint may be disposed between wheels when the first frame portion is rotated proximate to the frame. Additionally or alternatively, the frame may include a right side member and a left side member that each engage an opposite side of the working assembly.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A grinding or polishing machine comprising:

a working assembly including a grinding head rotatable to engage a surface for grinding or polishing; and a foldable cart releasably coupled to the working assembly, the foldable cart comprising:

a mobility assembly including at least one wheel and a frame; and a handle assembly operably coupled to the frame, wherein the handle assembly includes a first frame portion and a second frame portion, the first frame portion and the second frame portion being operably coupled to each other via a folding joint, wherein the first frame portion is rotatably coupled to the frame, wherein the folding joint is operable to be locked in at least an operating position in which the first frame portion and the second frame portion lie substantially in a same plane and a folded position in which the first frame portion and the second frame portion lie in different planes, wherein the folding joint comprises a pivot axis about which the folding joint is able to rotate, and wherein the folding joint comprises an arcuate shaped slot coaxial with the pivot axis, the arcuate shaped slot having at least one notch extending in a mainly radial direction relative to the pivot axis, and corresponding to the operating position.

2. The grinding or polishing machine of claim 1, wherein the folded position comprises a plurality of folded positions, and wherein the first frame portion lies in a first plane substantially parallel to and spaced apart from a second plane in which the second frame portion lies in at least one of the plurality of folded positions.

3. The grinding or polishing machine of claim 1, wherein the folding joint is able to rotate over a range of about 180 degrees.

4. The grinding or polishing machine of claim 1, wherein the folding joint comprises a locking assembly, the locking assembly being disposed proximate to the folding joint to enable a detent extending parallel to the pivot axis to be selectively inserted into the at least one notch based on operation of the locking assembly.

5. The grinding or polishing machine of claim 1, wherein the at least one notch comprises a plurality of notches, each notch of the plurality of notches corresponding to one of the folded position or the operating position.

6. The grinding or polishing machine of claim 1, further comprising a handle disposed at a distal end of the second frame portion, the handle being rotatable between a stowed position in which the handle lies proximate to the second frame portion and an extended position in which the handle is rotated to form an obtuse angle between the second frame portion and the handle.

7. The grinding or polishing machine of claim 6, wherein the first frame portion forms an acute angle relative to the frame responsive to attachment of a support member to the frame at a rear bracket of the frame.

8. The grinding or polishing machine of claim 1, further comprising a support member pivotally attached at a first end thereof to the first frame portion and releasably attachable at a second end thereof to the frame.

9. The grinding or polishing machine of claim 1, wherein the frame of the mobility assembly, the first frame portion and the second frame portion each lie substantially parallel to each other when the handle assembly is in the folded position.

10. The grinding or polishing machine of claim 9, wherein the frame of the mobility assembly is removably attachable to a support member via a threaded fastener.

11. The grinding or polishing machine of claim 1, wherein a width of the frame of the mobility assembly is greater than a width of the second frame portion, and wherein the first frame portion has a first width proximate to the folding joint, the first width being substantially equal to the width of the second frame portion, and a second width proximate to a mounting bracket of the frame at which the frame releasably connects to the working assembly, the second width being substantially equal to the width of the frame.

12. The grinding or polishing machine of claim 1, wherein the working assembly is releasably attachable via a removable screw or pin to either of a mounting bracket or the first frame portion.

13. The grinding or polishing machine of claim 12, wherein the folding joint is disposed between wheels when the first frame portion is rotated proximate to the frame.

14. The grinding or polishing machine of claim 1, wherein the first frame portion is rotatable at a mounting bracket to enable the first frame portion to be rotated proximate to the frame.

15. A grinding or polishing machine of claim 1, wherein the frame comprises a right side member and a left side member that each engage an opposite side of the working assembly.

* * * * *